United States Patent [19]

Tincati

[11] Patent Number: 4,479,343

[45] Date of Patent: Oct. 30, 1984

[54] DEVICE FOR FEEDING-IN AND MOVING-ON CONTAINERS TO AND FROM A ROTARY CAPPING UNIT

[76] Inventor: Franco Tincati, Via Anna Frank 7, Parma, Italy, 43100

[21] Appl. No.: 373,047

[22] Filed: Apr. 29, 1982

[30] Foreign Application Priority Data

May 6, 1981 [IT] Italy ..... 42506 A/81

[51] Int. Cl.[3] ..... B65B 7/28; B67B 3/00

[52] U.S. Cl. ..... 53/287; 198/481

[58] Field of Search ..... 53/278, 281, 282, 329, 53/340, 308, 287; 198/480, 481

[56] References Cited

U.S. PATENT DOCUMENTS

| | | | |
|---|---|---|---|
| 2,126,998 | 8/1938 | Lewis et al. | 53/278 X |
| 2,164,530 | 7/1939 | Larsen | 53/281 |
| 3,309,836 | 3/1967 | Hallowell, Jr. | 53/282 X |
| 3,601,954 | 8/1971 | Aronson | 53/282 |
| 4,109,446 | 8/1978 | Krohn et al. | 53/282 |
| 4,159,608 | 7/1979 | Masuda et al. | 53/282 |

*Primary Examiner*—Horace M. Culver
*Attorney, Agent, or Firm*—Darby & Darby

[57] ABSTRACT

Apparatus for feeding containers to a rotary capping machine and removing the containers therefrom, comprises a carrier wheel pivoting about a fixed axis lying parallel to and offset from the capping unit axis of rotation. The carrier wheel takes containers ready for capping from a first conveyor and draws them through a path describing a circumferential arc thence to deposit them on a second conveyor; the carrier is disposed in such a way that the circumferential arc travelled by containers achieves concurrence with pitch circumference established by rotation of the capping unit. The carrier is supported by a plate, by way of an antifriction bearing, caused to rotate by a gear pairing with the carrier wheel inner surface and revolving as one with the capping unit center shaft.

5 Claims, 4 Drawing Figures

DEVICE FOR FEEDING-IN AND MOVING-ON CONTAINERS TO AND FROM A ROTARY CAPPING UNIT

BACKGROUND OF THE INVENTION

This invention relates to a device which, incorporated into a rotary bottle/jar capping machine, serves to feed in and remove the individual containers.

Containers for capping are moved along a conveyor generally forming a part of a filling machine, from where a first carrier wheel takes the filled bottles or jars onto a rotary capping unit; once capped, the bottles are transferred by a second carrier wheel onto a conveyor belt.

Conventional such devices have several drawbacks:

the time-lapse between filling and capping is too great and can give rise to deterioration of the product in the container;

during its passage through the line, the bottle or jar undergoes frequent change of direction which, given the high speed operation of plant of this kind, can cause spillage of liquid or foodstuff from the container mouth;

different shapes and sizes of bottle/jar present a real production drawback as a considerable number of machine parts making up the device need changing over.

The device described herein eliminates drawbacks thus described whilst providing the following advantages: a marked reduction in the time-lapse between completion of container-filling and the moment of capping; filled containers subject to no sudden change in path direction; simplified procedure for production using different container formats involving changeover of a limited number of machine parts.

Furthermore, the device to which the invention relates takes up little space, reducing the overall size of plant making use thereof.

SUMMARY OF THE INVENTION

The device described herein embodies the above-mentioned and other advantages, characterized by the fact that it comprises: a rotary carrier pivoting about a fixed axis lying parallel with whilst offset from the capping unit axis of rotation, and serving to take containers from a first conveyor, draw them through a path describing a circumferential arc, and deposit them on a second conveyor, said carrier being disposed in such a way that the circumference-arc path travelled by containers becomes concurrent with the capping unit pitch circumference; and means for driving the rotary carrier and capping unit to impart identical tangential speed to both rotating components.

BRIEF DESCRIPTION OF THE DRAWINGS

Further features and advantages of the invention will emerge more clearly from the following detailed description of a preferred though not exclusive mode of embodiment for the device described herein, illustrated as a strictly unlimitative example with the aid of accompanying drawings, in which.

DESCRIPTION OF THE PREFERRED EMBODIMENT

Figure 1:
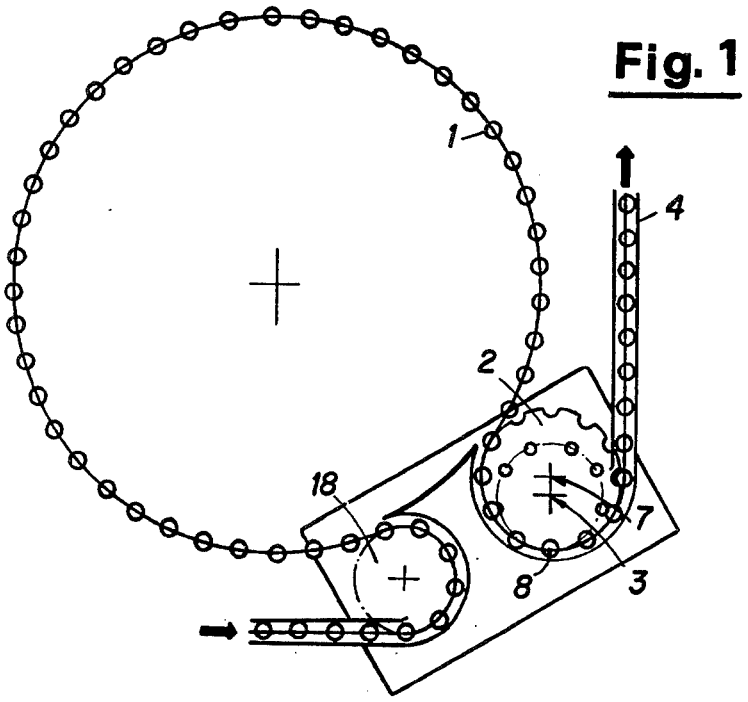
FIG. 1 is a schematic representation of the device described herein, being a plan from above of full containers being taken from a filling machine and deposited on an exit conveyor.
Figure 2:
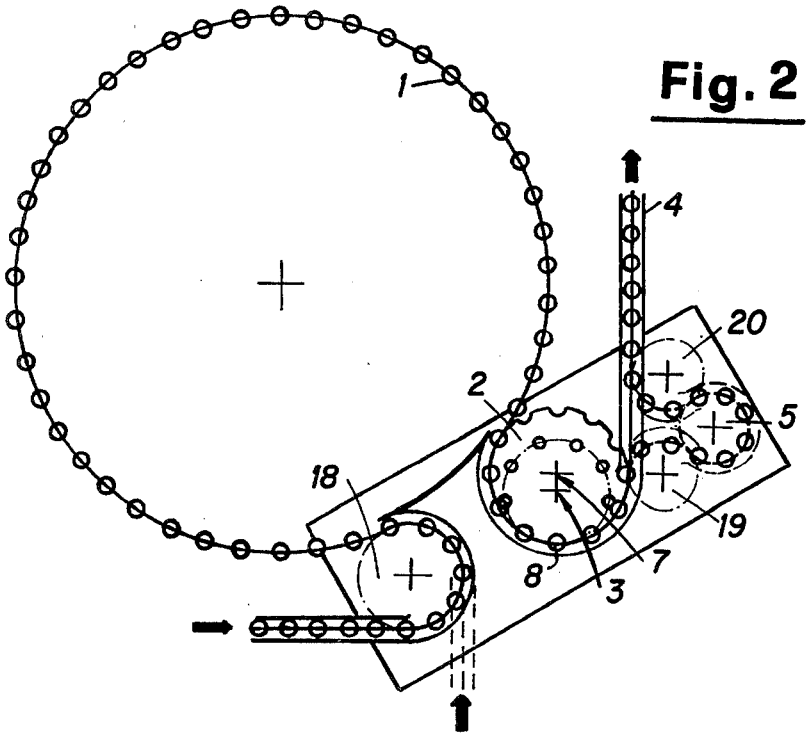
FIG. 2 shows the device herein described schematically, from above, taking containers from a filling machine and moving them into a further unit included in the production line.
Figure 3:
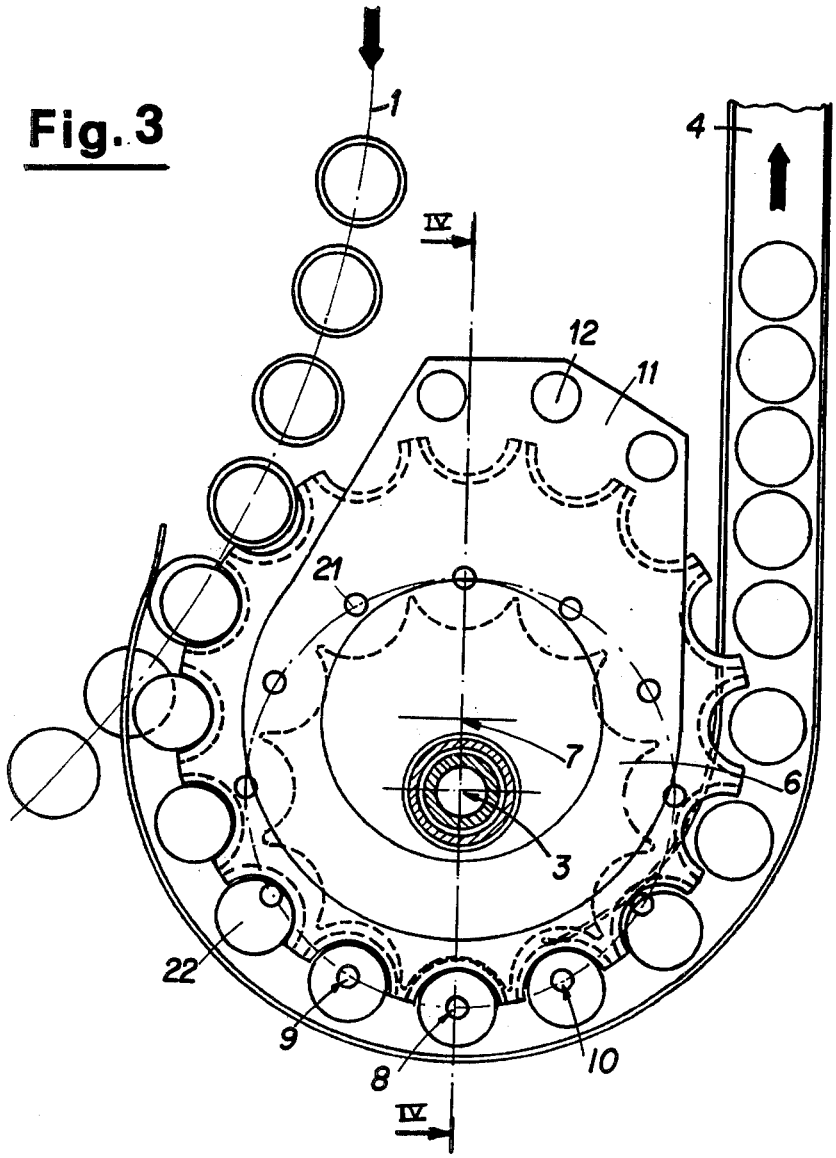
FIG. 3 shows a scheme from above of the device proper to which the invention relates, on larger scale.
Figure 4:
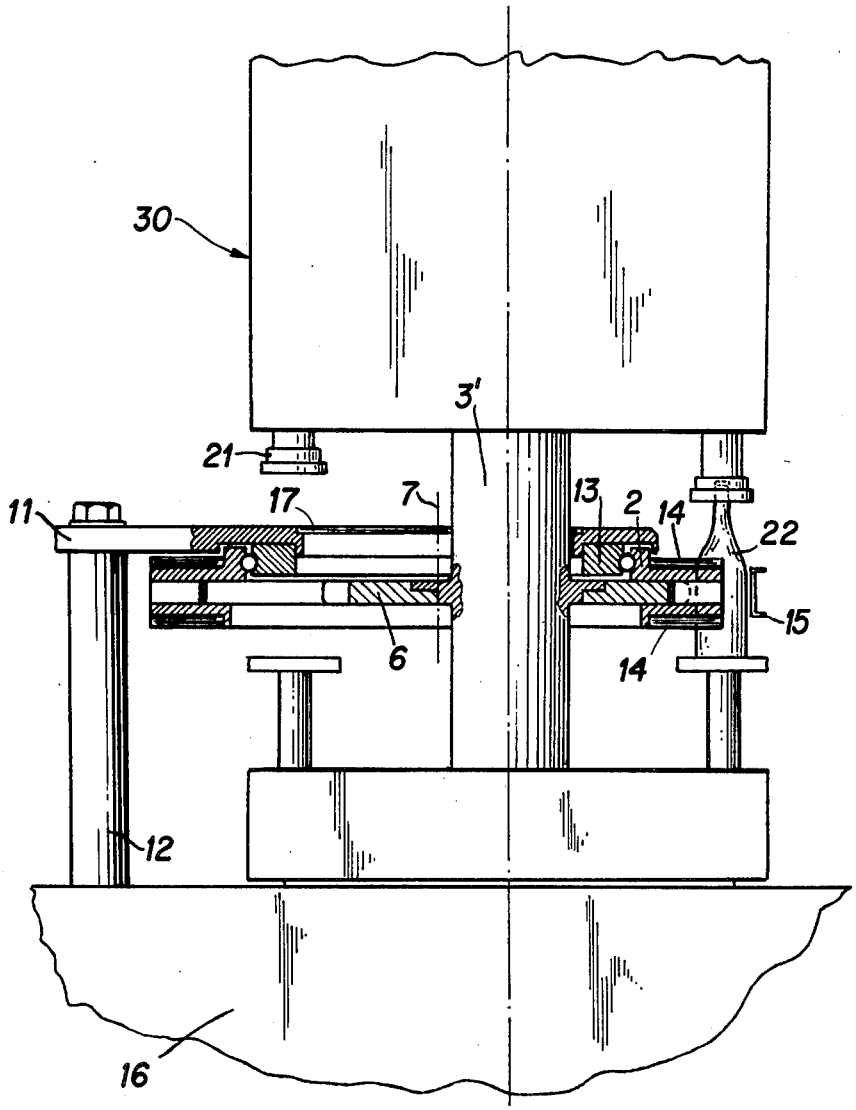
FIG. 4 is a section through the device made at IV—IV in FIG. 3.

The device described herein is incorporated into a capping unit 30 of which FIGS. 1, 2 and 3 show only the actual jigs 21 plus a traced-and-dotted line marking the pitch circumference described by rotation of the unit 30 about a fixed axis 3.

The device proper comprises a carrier wheel 2 furnished with peripherally-disposed recesses 14 which accommodate containers for capping, the wheel itself 2 being caused to rotate about a fixed axis 7 lying parallel with and offset from the main capping unit axis 3 of rotation. The carrier 2 takes the single bottles/jars, or containers 22 from a first conveyor 1—illustrated in the drawings as forming part of a filling machine, for instance—and moves them through a path describing a circumferential arc, thereafter depositing them onto a second conveyor 4. FIG. 2 demonstrates the passage of containers 22 from point of exit on carrier wheel 2 to a further production line unit 5 by way of an adjoining carrier wheel 19, thence to be returned to conveyor 4 by way of yet another wheel 20.

Carrier wheel 2 is disposed in such a way that the circumferential arc travelled by containers 22 achieves concurrence with the capping unit pitch circumference. FIG. 3 illustrates the manner in which the rotary capping unit pitch circumference lies within that of the carrier wheel and creates a tangent therewith through point 8, where capping takes place. The wheel can be disposed in such a way that the pitch circumference of capping unit and carrier intersect, in which case either circumference will possess two points of contact, viz. 9 and 10, the actual capping being effected along the arc lying between said points 9 and 10. In this instance a more generous capping time-lapse is provided.

Provision is made for driving carrier wheel 2 and capping unit 30 alike in such a way that both revolve at identical tangential speed, said means comprising a gear 6 showing appropriately-shaped teeth and rotating coaxially as one with a shaft 3', about which rotation is produced both of the capping unit and of the carrier wheel 2. The carrier wheel 2 has an annular body whose internal surface offers the requisite profile for its pairing with gear 6 aforesaid. A plate 11 is supported by a vertical post 12 rising from the capping unit base-structure 16. The plate 11, post 12 and structure 16 are immovable one with respect to the other. The plate 11 affords the mounting for an antifriction bearing, the inner ring of whose race 13 is affixed thereto whilst the outer ring turns as one with carrier wheel 2. Mounting plate 11, carrier wheel 2, and the inner ring 13 of the antifriction bearing all present a center opening through which capping unit shaft 3' may pass.

The mounting plate 11 thus described lies above the device proper, and is furnished with a protective shield 17 for the purpose of precluding entry of such foreign bodies as may damage the device innermost (glass splinters, for example, in the case of jars or bottles).

The device functions in the following manner: containers for filling are led into the filling unit 1, for instance by way of an entry carrier wheel 18; the containers 22 exit singly from the filling machine and are taken up by carrier wheel 2 which moves them through a path describing a circumferential arc, during which stage support is afforded to the undersides thereof by a metallic guide not shown in the drawings.

Whilst moving through said path containers 22 meet with the capping unit pitch circumference and are duly set onto the unit capping-stands which revolve as one with the overall capping machine. Capping takes place by means of jigs 21 either at point 8 or along the arc contained within points 9 and 10, depending upon whether the pitch circumferences of capping unit and carrier wheel are disposed tangentially (point 8) or intersect one another (points 9 and 10); thus, during capping, containers 22 move through a path achieving concurrence with pitch circumferences both of the capping unit and the carrier wheel.

Once capped, the containers 22 are moved along by carrier wheel 2 onto an exit conveyor 4.

Different sizes and shapes of containers are accommodated simply by changing carrier recesses 14.

Numerous modifications of a practical nature may be made to the constructive details of the invention without departing from the concept as claimed below.

What is claimed:

1. Apparatus for feeding containers to a rotary capping unit and removing the containers therefrom, comprising first and second conveyors, a rotary carrier wheel, said wheel being rotatable about a fixed axis lying parallel with and offset from the axis of rotation of the capping unit and serving to take containers from said first conveyor, draw them through a path describing a circumferential arc, and deposit them on said second conveyor, said wheel being disposed in such a way that said path achieves concurrence with the pitch circumference established by rotation of the capping unit; and means for driving said rotary carrier and capping unit in substantially identical tangential speeds.

2. Apparatus according to claim 1 wherein the pitch circumference of the capping unit lies both within and at a tangent to the carrier wheel pitch circumference.

3. Apparatus according to claim 1 wherein the pitch circumference of the capping unit lies substantially within while intersecting the carrier wheel pitch circumference.

4. Apparatus according to claim 1 further comprising a center shaft for said capping unit, an antifriction bearing formed with an inner ring and an outer ring, and a mounting plate, said mounting plate lying above said carrier wheel and being connected to the capping unit and affording an opening through which said center shaft is able to pass, said inner ring being rigidly connected to said mounting plate and said outer ring revolving with said carrier wheel.

5. Apparatus according to claim 1 further comprising a center shaft for said capping unit, and wherein said carrier wheel is annular in shape and has a profiled inner surface; said drive means comprising a gear revolving coaxially and as one with the capping unit center shaft and having a toothed profile by means of which to pair with said inner surface.

* * * * *